US005938464A

United States Patent [19]

Ichimura et al.

[11] Patent Number: 5,938,464

[45] Date of Patent: Aug. 17, 1999

[54] CIRCUIT BOARD ELECTRICAL CONNECTOR WITH LATCH

[75] Inventors: Yutaka Ichimura; Ryozo Koyama, both of Tokyo, Japan

[73] Assignee: Hirose Electric Co., Ltd., Tokyo, Japan

[21] Appl. No.: 08/903,989

[22] Filed: Jul. 31, 1997

[30] Foreign Application Priority Data

Aug. 8, 1996 [JP] Japan ..... 8-209454

[51] Int. Cl.[6] ..... H01R 13/62

[52] U.S. Cl. ..... 439/327

[58] Field of Search ..... 439/326, 327, 439/328, 157

[56] References Cited

U.S. PATENT DOCUMENTS 5,669,782 9/1997 Yodogawa ..... 439/327

FOREIGN PATENT DOCUMENTS 3108286 5/1991 Japan .
3504180 9/1991 Japan .
4229965 8/1992 Japan .

*Primary Examiner*—Steven L. Stephan
*Assistant Examiner*—Eugene G. Byrd
*Attorney, Agent, or Firm*—Kanesaka & Takeuchi

[57] ABSTRACT

A circuit board electrical connector with a latch, includes an insulation housing (10) having a base section (11) with a slot (13) in which a plurality of contact elements (30) are arranged and a pair of side walls (12) extending laterally from opposite ends of the base section and having latch portions (18) at their free ends to latch a circuit board which is inserted into the slot and rotated to a latch position; and restriction portions (22, 22D) for preventing the latch portions from flexing in a direction other than a latch operation direction so that damage to the latch portions caused by excessive flexure in the directions is avoided.

10 Claims, 9 Drawing Sheets

CIRCUIT BOARD ELECTRICAL CONNECTOR WITH LATCH

BACKGROUND OF THE INVENTION

1. Field of the Invention

The present invention relates to circuit board electrical connectors into which circuit boards are plugged with low insertion forces and, particularly, to a circuit board electrical connector with a latch, which has a slot with contact elements arranged therein and a latch to secure the circuit board inserted into the slot and rotated by a predetermined angle.

2. Description of the Related Art

Recently, electrical connectors for connecting daughter boards having memory elements, etc. to mother boards having electronics components thereon are widely used. There are rotary type zero-insertion force connectors having an insulation housing with an slot into which a daughter board is inserted obliquely and then rotated into a latch portion.

Examples of such a rotary type zero-insertion force connector are disclosed in Japanese patent application Kokai Nos. 229965/92 and 108286/91 and Japanese patent application Kokoku No. 504180/91. A pair of flexible latch levers are provided at opposite ends of the slot of an insulation housing, and latch portions are provided on the upper ends of the latch levers. A daughter board is inserted obliquely into the slot of the insulation housing and then rotated so as to pass the latch portions of the flexible latch levers. When the daughter board passes the latch portions, the flexible latch levers snap the daughter board.

Daughter boards are plugged in the above electrical connectors either vertically or obliquely, but there are some circuit board electrical connectors with a latch, to which daughter boards are plugged in parallel to the mother boards. FIG. 10 shows part of such a circuit board electrical connector with a latch, which is mounted on a mother board.

The electrical connector 2 mounted on a mother board 1 includes an insulation housing 10 with a pair of side walls 12 having latch portions. The latch portions have a first movable arm 15 extending along a fixed portion 14 of the side wall 12, a second movable arm 16 extending from the first movable arm 15 and movable outwardly, and a latch engaging portion 18 extending from the second movable arm 15 to latch a daughter board (not shown) between the portion 18 and the rear wall 19. An operation knob 17 extends from the second movable arm 16. A metal fitting 20A is soldered to the mother board 1 to secure the fixed arm 14 of the side wall 12.

A daughter board is inserted obliquely into a slot provided between the side walls 12 and rotated toward the mother board 1. As the daughter board is rotated, it abuts on upper edges of the engaging portions 18 and flexes outwardly and passes the engaging portions 18. As soon as it passes the engaging portions 18, the movable arms 16 snap the daughter board with lower faces of the engaging portions 18. This completes connection of the daughter board to the electrical connector 2.

The above latch structures, however, lack satisfactory strength in a inward direction. Consequently, it is frequent that the latch portions are broken when the operator moves the latch portions inwardly without any daughter board inserted. In addition, when the latch portions are flexed forwardly, they are frequently broken.

SUMMARY OF THE INVENTION

Accordingly, it is an object of the invention to provide a circuit board electrical connector with a latch, which is free from the above problem.

According to one aspect of the invention there is provided a circuit board electrical connector with a latch, which includes an insulation housing having a base section with a slot in which a plurality of contact elements are arranged and a pair of side walls extending laterally from opposite ends of the base section and having latch portions at their free ends to latch a circuit board which is inserted into the slot and rotated to a latch position; and restriction portions for preventing the latch portions from flexing in a direction other than a latch operational direction so that damage to the latch portions caused by excessive flexure is avoided.

According to another aspect of the invention, the latch portions comprise movable arms extending along the side walls and flexible outwardly and engaging portions extending from the movable arms and latching the circuit board, the restriction porions comprise metal fittings for securing the side walls to a mother board and protruded portions extending from the metal fittings to such positions as to prevent inward movement of the movable arms of the latch portions. The protruded portions also extend to such positions as to prevent the movable arms from flexing forwardly.

According to yet another aspect of the invention, the latch portions comprise movable arms extending along the side walls and flexible outwardly and engaging portions extending from the movable arms to latch the circuit board, the restriction portions comprise hook portions extending from the side walls to restrict inward movement of the movable arms. The hook portions have such a form as to also prevent forward movement of the movable arms.

According to still another aspect of the invention the latch portions comprise a first moveable arms extending along the side walls and flexible outwardly, second movable arms extending from the first movable arms and flexible outwardly, and engaging portions extending from the second movable arms to latch the circuit board, the restriction portions comprise protruded portions extending from the metal fittings for securing the side walls to a mother board, the protruded portions extending to such positions as to prevent inward movement of the second movable arms. The protruded portions are flexed to such position as to not block plugging the circuit board.

According to another aspect of the invention the protruded portions are provided with recesses so that top portions of the protruded portions are readily flexed in a direction where the circuit board is rotated.

According to still another aspect of the invention the restriction means comprise resilient arms provided between the top portion and the metal fitting as to permit flexure of the top portion by the circuit board.

According to yet another aspect of the invention the latch portions comprise first movable arms extending along the side walls and flexible outwardly, second flexible arms extending from the first movable arms and flexible outwardly, and engaging portions extending from the second movable arms and latching the circuit board, the restriction portions comprise hook portions to restrict inward flexure of the second movable arms. The hook portions have such forms as to prevent also forward flexure of the second movable arms.

DESCRIPTION OF THE PREFERRED EMBODIMENT

Figure 1:
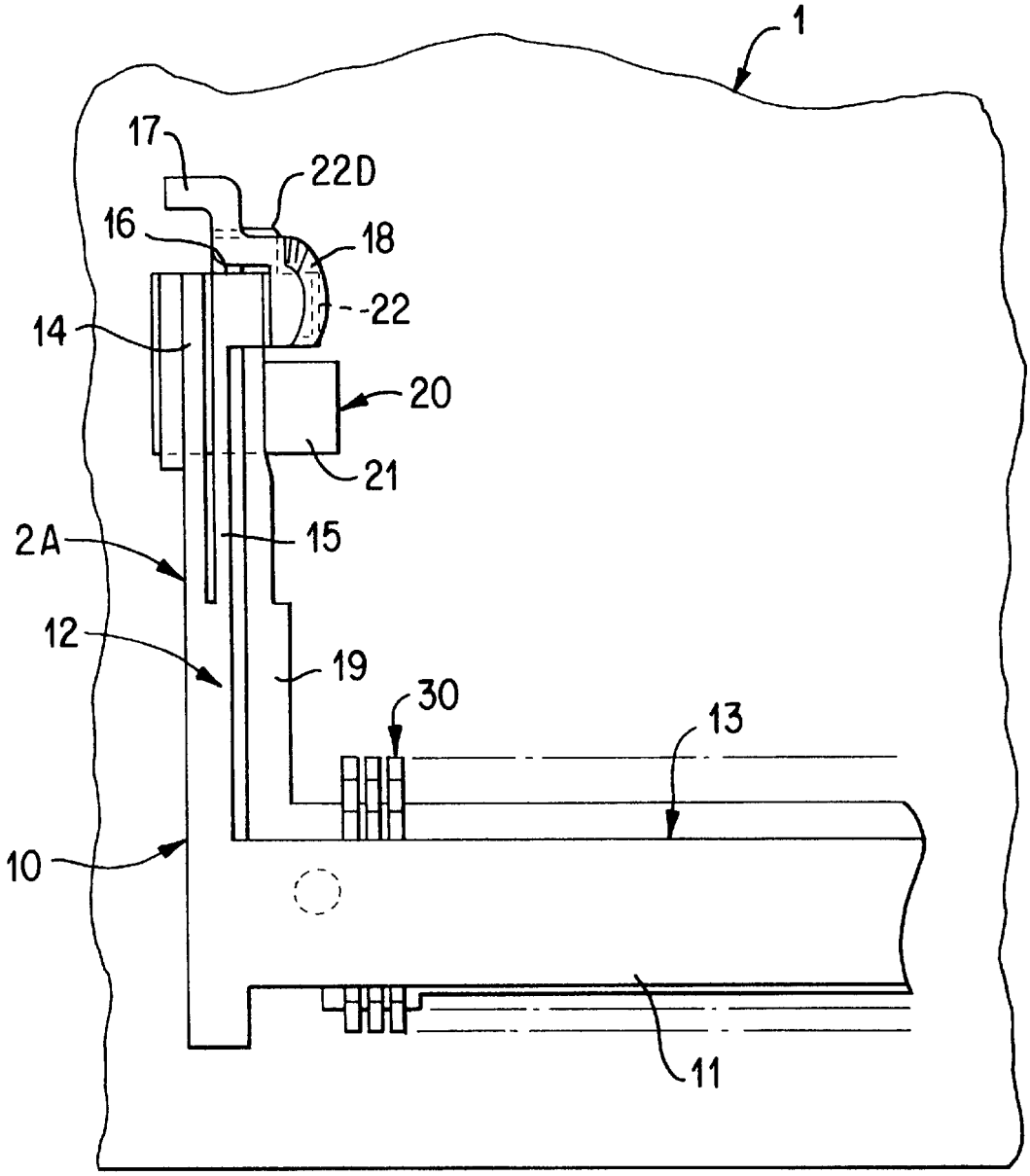
FIG. 1 is a plan view of part of a circuit board electrical connector with a latch according to an embodiment of the invention.

In FIG. 1, a circuit board electrical connector with a latch 2A includes an insulation housing 10 mounted on a mother board 1. The insulation housing 10 has a base section 11 having a slot 13 into which a daughter board (not shown) is inserted obliquely and then rotated about its leading edge to a position where the daughter board is parallel to the mother board 1. The daughter board is a printed circuit board on which memory modules, etc. are mounted.

A plurality of pads are arranged on an edge of the daughter board with a predetermined pitch. These pads are electrically connected to corresponding terminals of various components, such as memories, mounted on the daughter board via a predetermined conductive pattern. Such a structure of the daughter board is not essential part of the invention but conventional, and its detailed description will be omitted herein.

A plurality of terminal slits are provided in the side and bottom walls of the slot 13 of the insulation housing 10 with the same pitch as that of the pads on the daughter board for receiving contact elements 30.

Figure 2:
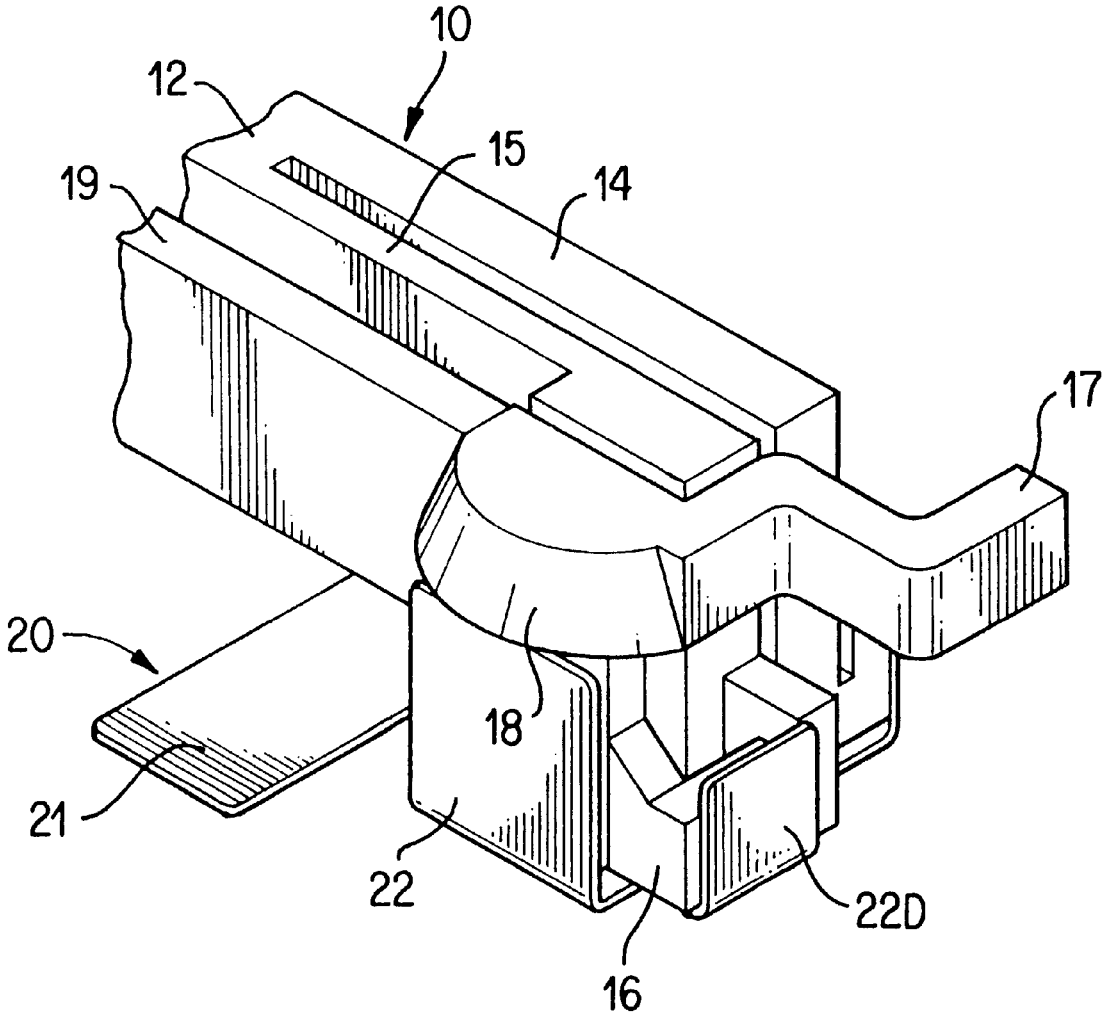
FIG. 2 is a perspective view of a latch portion provided on a side wall of a insulation housing for the electrical connector.

A pair of side walls 12 extend laterally from opposite ends of the slot 13 of the base section 11, and latch portions are provided on the upper ends of the side walls 12. FIG. 2 shows one of the latch portions provided on the side wall 12.

In FIG. 2, the latch portion includes a first movable arm 15 extending along a fixed arm 14 of the side wall 12 and flexible outwardly, a second movable arm 16 extending from the first movable arm 15 and flexible outwardly, and an engaging portion 18 extending from the second movable arm 16 for latching a daughter board between a rear wall 19 and the engaging portion 18. An operation knob 17 extends from the second movable arm 16.

The fixed arm 14 is secured to the mother board 1 with a metal fitting 20 which is soldered to the mother board 1. A protruded portions 22 and 22D are integrated with the metal fitting 20. The protruded portion 22 extends from a soldering portion 21 of the metal fitting 20 to a position to prevent the second movable arm 16 from flexing inwardly. The soldering portion 21 is soldered to a corresponding pad of the mother board 1 to secure the fixed arm 14 of the electrical connector 2A. The upper end of the protruded portion 22 terminates at a position where a daughter board is plugged in and out without difficulty.

If the operation knob 17 is pressed inwardly without any daughter board inserted, inward movement of the second movable arm 16 is prevented by the protruded portion 22 of the metal fitting 20 so that any damage to the second movable arm 16 caused by excessive inward movement is avoided. If the operation knob 17 is pressed forward, forward movement of the second movable arm 16 is prevented by the protruded portion 22D of the metal fitting 20 so that any damage to the second movable arm 16 by excessive forward movement is avoided.

Figure 3:
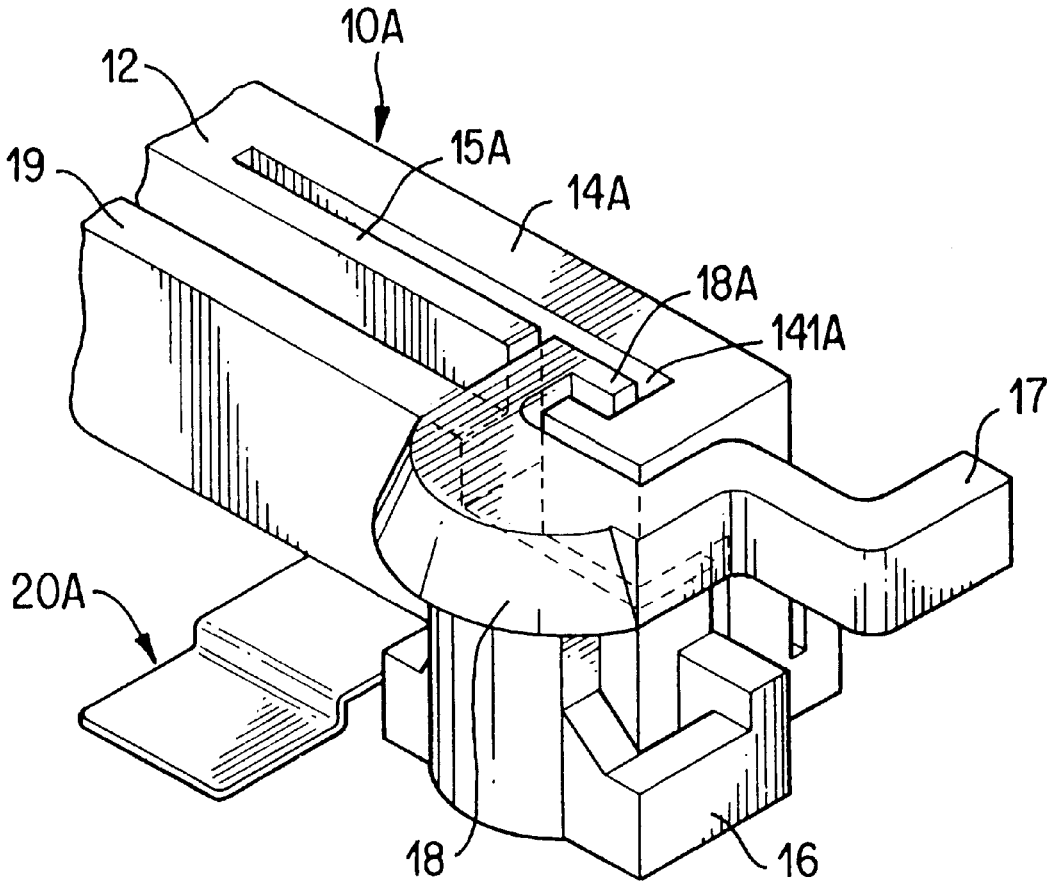
FIG. 3 is a perspective view of a latch portion of a circuit board electrical connector according to another embodiment of the invention.
Figure 10:
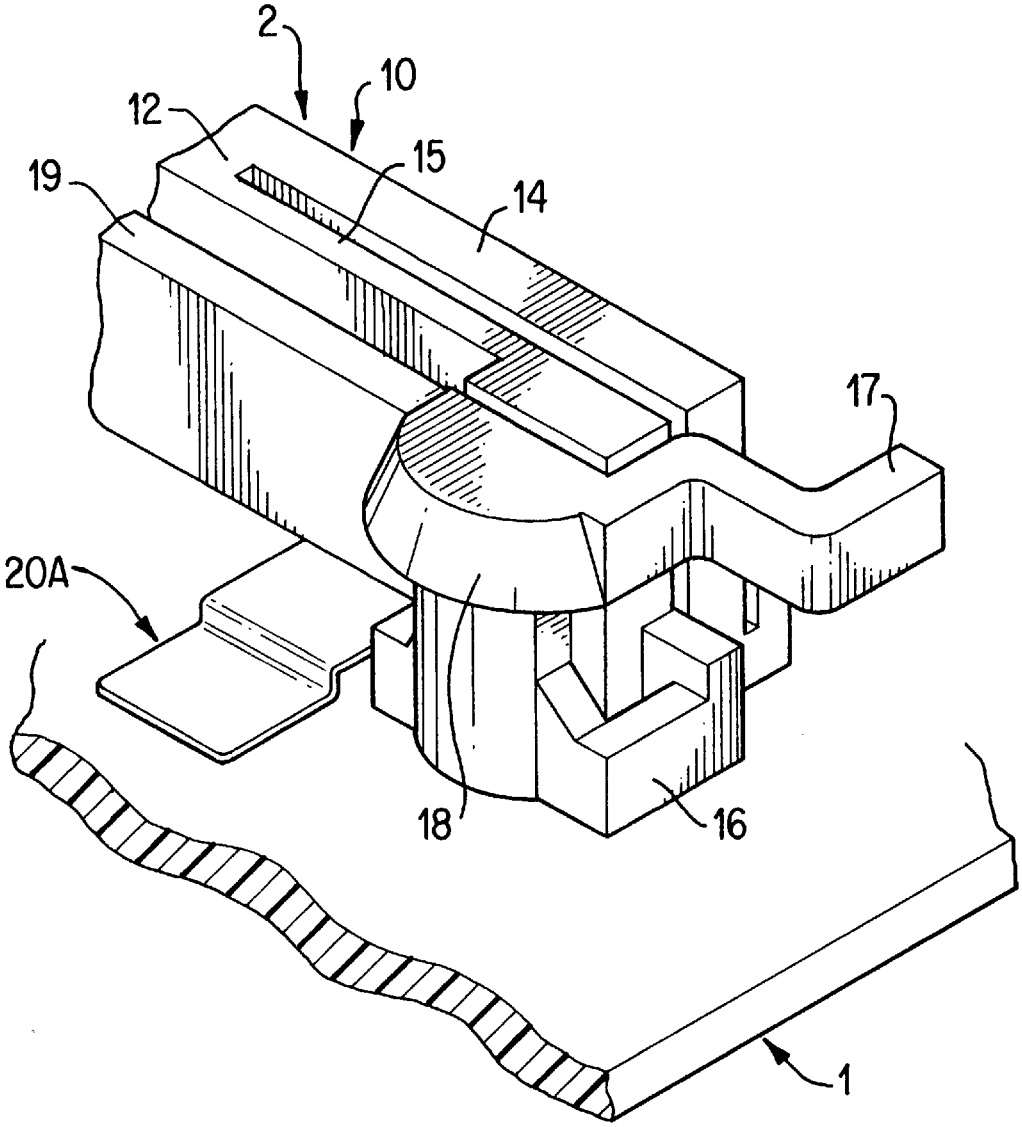
FIG. 10 is a perspective view of a latch portion of a conventional circuit board electrical connector with a latch, which is mounted on a mother board.

In FIG. 3, an inner hook portion 18A is provided on the engaging portion 18, and the front end of the fixed arm 14A surrounds the inner hook portion 18A to form an outer hook portion 141A. The metal fitting 20A is the same as that of FIG. 10.

If the operation knob 17 is pressed inwardly without any daughter board inserted, inward movement of the second movement arm 16 is restricted by engagement between the inner and outer hook portions 18A and 141A so that any damage to the second movable arm 16 caused by excessive inward movement is avoided. If the operation knob 17 is pressed forward, forward movement of the second movable arm 16 is restricted by engagement between the inner and outer hook portions so that any damage to the second movable arm 16 caused by excessive forward movement is avoided.

Figure 4:
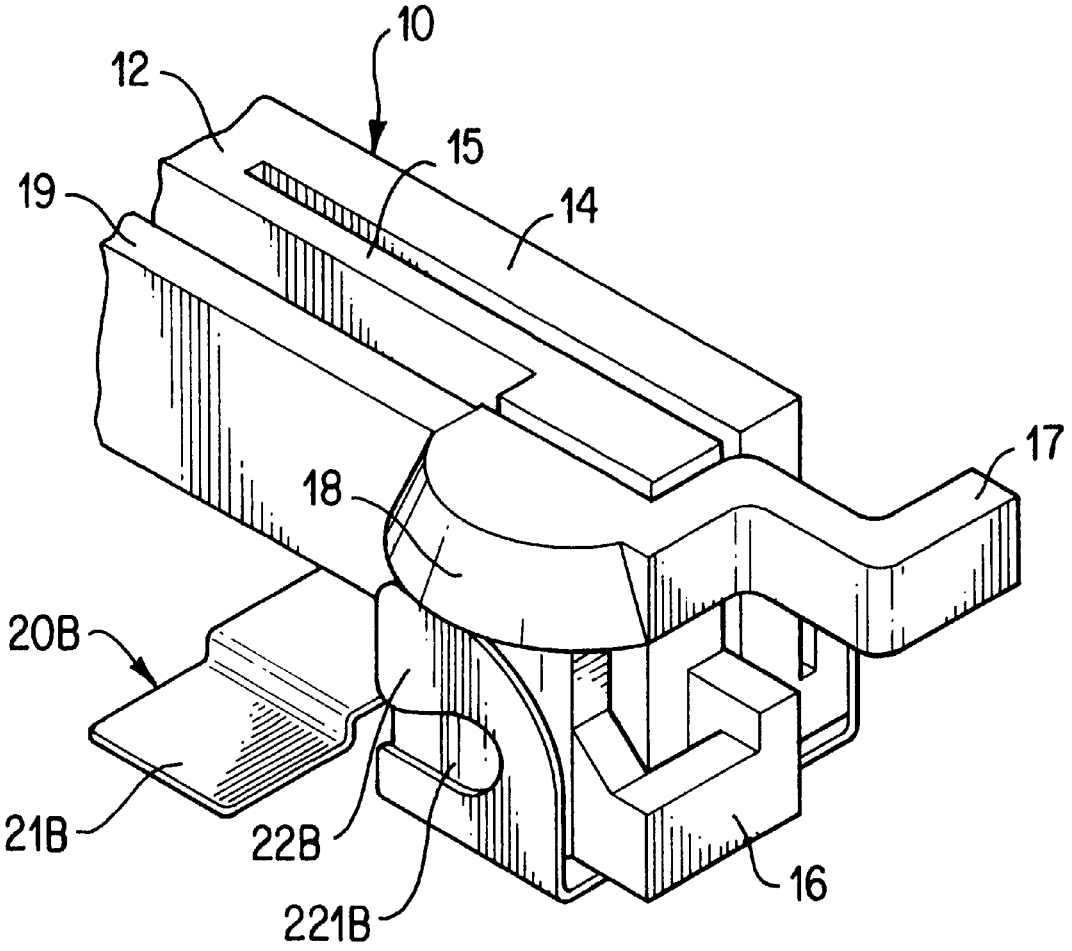
FIG. 4 is a perspective view of a latch portion of a circuit board electrical connector according to still another embodiment of the invention.

In FIG. 4, a protruded portion 22B extends from a metal fitting 20B to a lower face of the engaging portion 18 to restrict downward flexure of the second movable arm 16. A recess 221B is provided in the protruded portion 22B to facilitate flexure of the top portion of the protruded portion 22B. A soldering portion 21B is provided on the metal fitting 20B and soldered to the corresponding pad of a mother board to secure the fixed arm 14 of the insulation housing 10.

Figure 5:
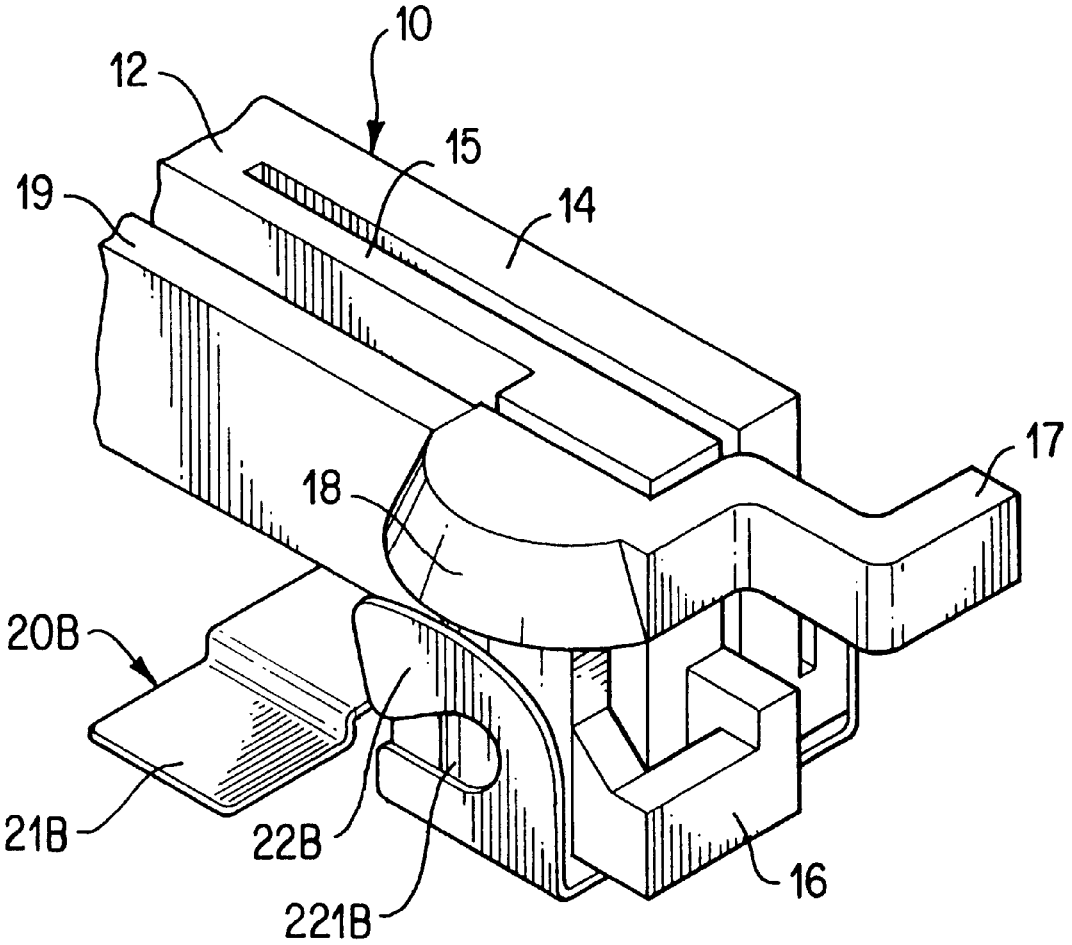
FIG. 5 is a perspective view of the latch portion of FIG. 4 when a daughter board is plugged in the electrical connector.

If the operation knob 17 is pressed inwardly without any daughter board inserted, inward movement of the second movable arm 16 is prevented by the protruded portion 22B of the metal fitting 20B so that damage to the second movable arm 16 by excessive inward movement is avoided. When a daughter board is inserted into the electrical connector and rotated so as to pass the engaging portions 18, the daughter board presses down the protruded portions 22B before completing the connection. FIG. 5 shows how the protruded portion 22B undergoes such resilient deformation. (The daughter board is not shown.)

Figure 6:
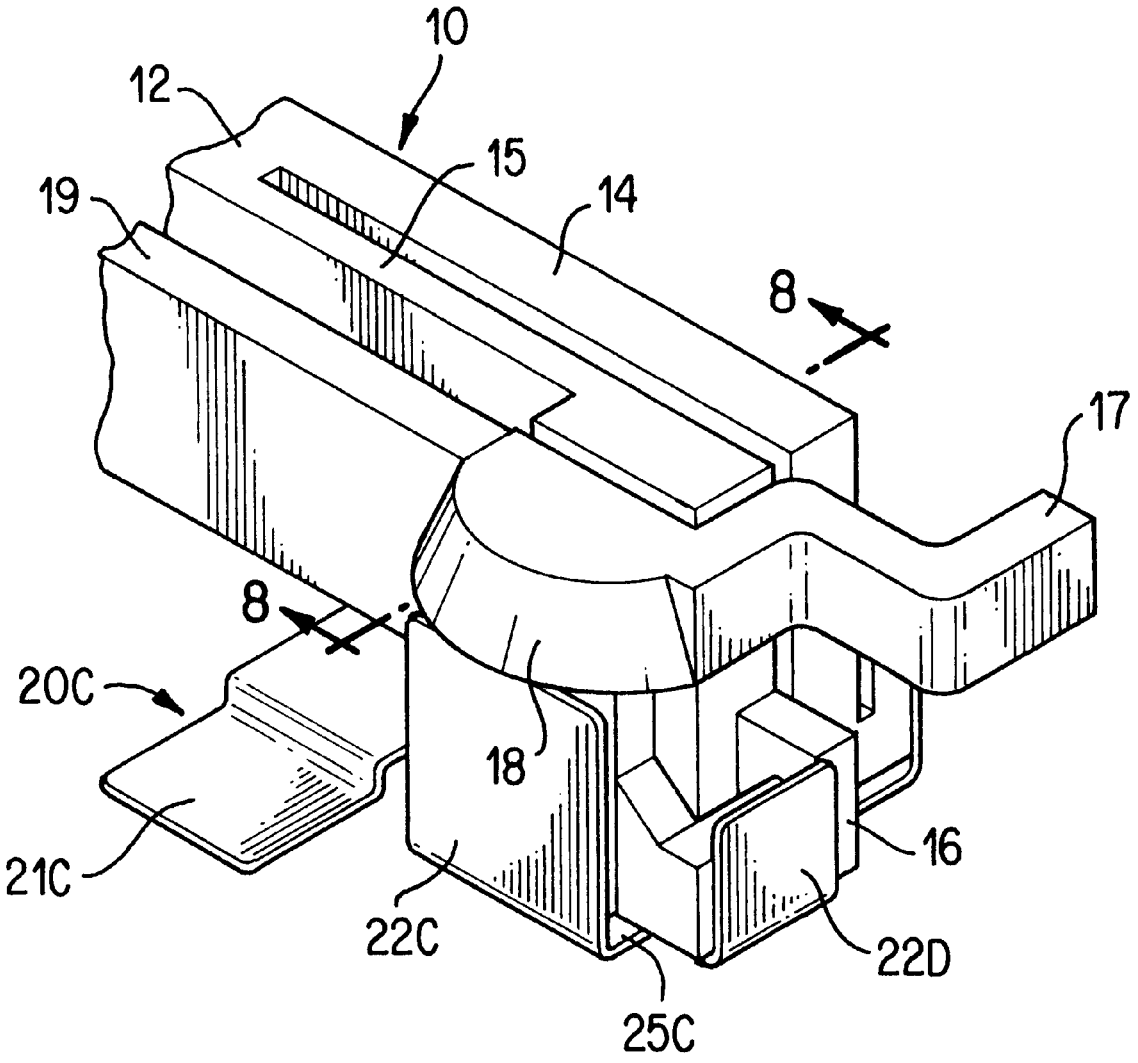
FIG. 6 is a perspective view of a circuit board electrical connector with a latch according to yet another embodiment of the invention.

In FIG. 6, protruded portions 22C and 22D extend from the metal fitting 20C.

Figure 7:
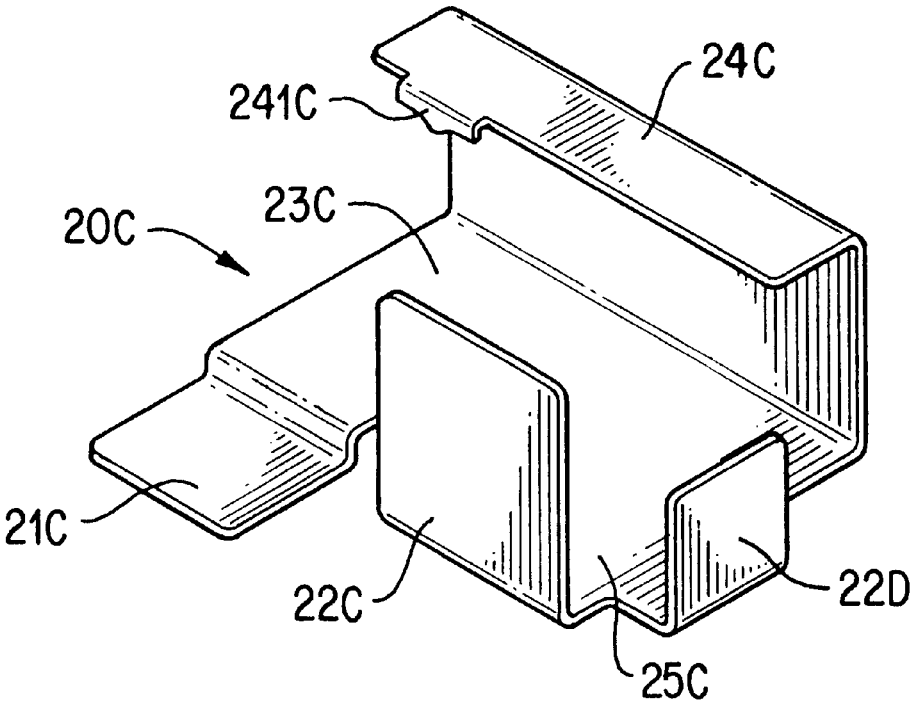
FIG. 7 is a perspective view of a metal fitting for the electrical connector of FIG. 6.

In FIG. 7, the metal fitting 20C has a soldering section 21C, a raised rear section, and a front section with the protruded portions 22C and 22D. A linking section 23C links the rear and front sections, and a fixing section 24C is provided across the rear and front sections. A press-fit engaging projection 241C is provided on the fixing section 24C. By engaging the engaging projection 241C with an engaging groove (not shown) of the fixed arm 14 it is possible to secure the electrical connector to the mother board. A resilient arm 25C is provided in the front section to link the fixing section 24C and the protruded portion 22C. The top of the protruded portion 22C extends up to a lower face of the engaging portion 18 to restrict flexure of the second movable arm 16.

If the operation knob 17 is pressed inwardly without any daughter board inserted, inward movement of the second movable arm 16 is restricted by the protruded portion 22C of the metal fitting 20 so that damage to the second movable arm 16 caused by excessive inward movement is avoided. If the operation knob 17 is pressed forwardly, forward movement of the second moveable arm 16 is restricted by the protruded portion 22D of the metal fitting 20 so that damage to the second moveable arm 16 caused by excessive forward movement is avoided.

Figure 8:
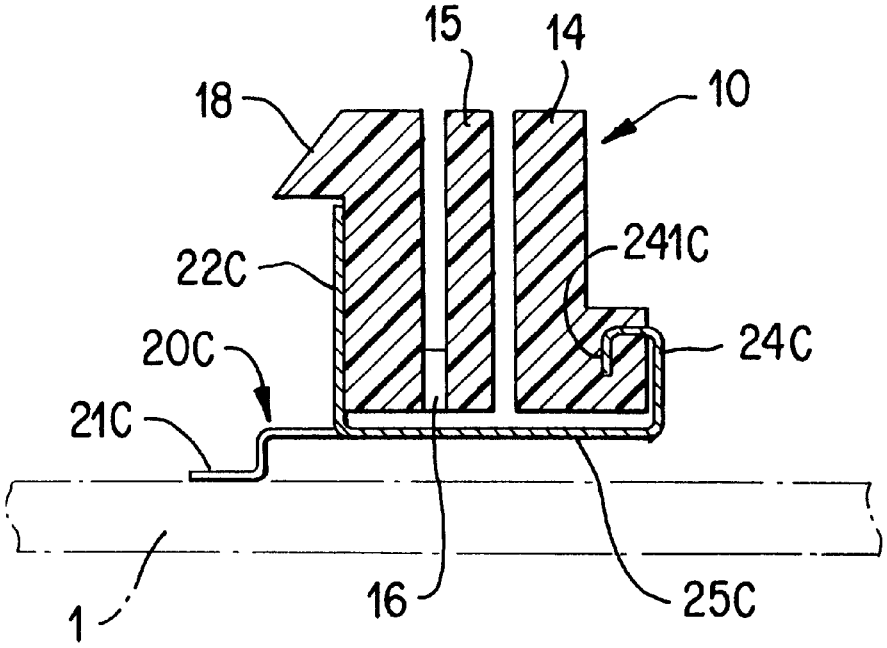
FIG. 8 is a sectional view taken along line 8—8 of FIG. 6.
Figure 9:
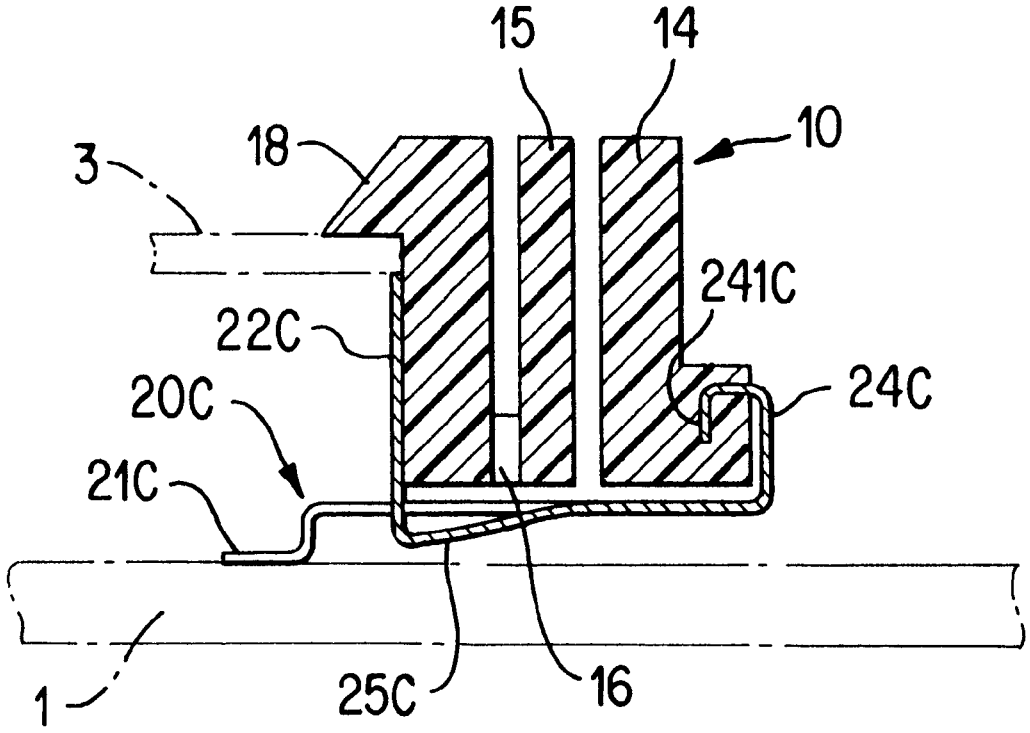
FIG. 9 is a sectional view taken along line 8—8 of FIG. 6, wherein a daughter board is plugged in the electrical connector.

How the metal fitting 20C works when a daughter board is plugged in the electrical connector will be described with reference to FIGS. 8 and 9. In FIG. 8, when no daughter board is plugged in, the top of the protruded portion 22C of the metal fitting 20C extends along the second movable arm 16 to the lower face of the engaging portion 18 to prevent the second movable arm 16 from flexing inwardly. When a daughter board 3 is inserted into the electrical connector and rotated, it passes the engaging portions 18 while pressing down the top portion of the protruded portion 22C. FIG. 9 shows how the protruded portion 22C of the metal fitting 20C is resiliently deformed hen the daughter board 3 is plugged in the electrical connector. The resilient arm 25C flexes to facilitate the movement of the protruded portion 22C within a space between the mother board 1 and the metal fitting 20C.

As has been described above, according to the invention, if the latch portion is moved in a direction other than the latch operational direction, movement of the latch is restricted to prevent damage to the latch portion.

The metal fitting and/or the side walls of the insulation housing are changed but no new component or part is introduced so that an increase of the manufacturing cost of the electrical connector is avoided.

What is claimed is:

1. A circuit board electrical connector with a latch comprising:

an insulation housing having a base section with a slot in which a plurality of contact elements are arranged and a pair of side walls extending laterally from opposite ends of said base section to form an accommodation space for a circuit board and having latch portions at their free ends to latch a circuit board which is inserted into said slot and rotated to a latch position: and restriction means for preventing said latch portions from flexing in a direction other than a latch operation direction so that damage to said latch portions caused by excessive flexure is avoided, wherein said latch portions comprise movable arms extending along said side walls and flexible outwardly and engaging portions extending from said movable arms and latching said circuit board, and said restriction means comprise metal fittings for securing said side walls to a mother board and protruded portions provided outside said accommodation space and extending from said metal fittings to such positions as to prevent inward movement of said movable arms of said latch positions.

2. A circuit board electrical connector with a latch according to claim 1, wherein said protruded portions also extend to such positions as to prevent said movable arms from flexing forwardly.

3. A circuit board electrical connector with a latch, comprising:

an insulation housing having a base section with a slot in which a plurality of contact elements are arranged and a pair of side walls extending laterally from opposite ends of said base section to form an accommodation space for a circuit board and having latch portions at their free ends to latch a circuit board which is inserted into said slot and rotated to a latch position; and restriction means for preventing said latch portions from flexing in a direction other than a latch operation direction so that damage to said latch portions caused by excessive flexure is avoided, wherein said latch portions comprise movable arms extending along said side walls and flexible outwardly and engaging portions extending said movable arms to latch said circuit board, and said restriction means comprise hook portions provided outside said accommodation space and extending from said engaging portions to restrict inward movement of said movable arms.

4. A circuit board electrical connector with a latch according to claim 3, wherein said hook portions have means for preventing forward movement of said movable arms.

5. A circuit board electrical connector with a latch comprising:

an insulation housing having a base section with a slot in which a plurality of contact elements are arranged and a pair of side walls extending laterally from opposite ends of said base section to form an accommodation space for a circuit board and having latch portions at their free ends to latch a circuit board which is inserted into said slot and rotated to a latch position; and restriction means for preventing said latch portions from flexing in a direction other than a latch operation direction so that damage to said latch portions caused by excessive flexure is avoided, wherein said latch portions comprises;

first movable arms extending along said side walls and flexible outwardly;

second movable arms extending from said first movable arms and flexible outwardly; and engaging portions extending from said second movable arms to latch said circuit board;

said restriction means comprise protruded portions extending from said metal fittings for securing said side walls to a mother board;

said protruded portions provided said outside accommodation space and extending to such positions as to prevent inward movement of said second movable arms.

6. A circuit board electrical connector with a latch according to claim 1, 2, or 5, wherein said protruded portions are flexed to such position as to not block plugging said circuit board.

7. A circuit board electrical connector with a latch according to claim 6, wherein said protruded portions are provided with recesses so that top portions of said protruded portions are readily flexed in a direction where said circuit board is rotated.

8. A circuit board electrical connector with a latch according to claim 6, wherein said restriction means comprise a resilient arm provided between top portion and said metal fitting as to permit flexure of said top portion by said circuit board.

9. A circuit board electrical connector with a latch comprising:

an insulation housing having a base section with a slot in which a plurality of contact elements are arranged and a pair of side walls extending laterally from opposite ends of said base section to form an accommodation space for a circuit board and having latch portions at their free ends to latch a circuit board which is inserted into said slot and rotated to a latch position; and restriction means for preventing said latch portions from flexing in a direction other than a latch operation direction so that damage to said latch portions caused by excessive flexure is avoided, wherein said latch portion comprise;

first movable arms extending along said side walls and flexible outwardly;

second flexible arms extending from said first movable arms and flexible outwardly; and engaging portions extending from said second movable arms and latching said circuit board;

said restriction means comprise hook portions provided outside said accommodation space and extending from said engaging portions to restrict inward flexure of said second movable arms.

10. A circuit board electrical connector with a latch according to claim 9, wherein said hook portions have such forms as to prevent forward flexure of said second movable arms.

* * * * *